US012312915B2

(12) United States Patent
Pitchon Sampaio et al.

(10) Patent No.: US 12,312,915 B2
(45) Date of Patent: May 27, 2025

(54) ASSISTED AUTONOMOUS TREATMENT SYSTEM AND PROCESS IN PRE-SALT PRODUCTION PLATFORMS, AND THEIR USES

(71) Applicant: PETRÓLEO BRASILEIRO S.A.—PETROBRAS, Rio de Janeiro (BR)

(72) Inventors: Tatiana Pitchon Sampaio, Rio de Janeiro (BR); Lilia Naveira Bukahi, Rio de Janeiro (BR); Fernando Antonio Moreira Da Silva, Rio de Janeiro (BR); Marcelo Almeida Gomes, Rio de Janeiro (BR); Patricia Braga Gusmao, Rio de Janeiro (BR); Mario Germino Ferreira Da Silva, Rio de Janeiro (BR); Bernardo Caldeira Dias, Rio de Janeiro (BR); Leandro Fernandes Telles, Rio de Janeiro (BR); Valtair Marcos Cristante, Rio de Janeiro (BR); Geraldo Marcel Gomes Calil, Rio de Janeiro (BR); Pedro Andre Nogueria Souza De Oliveira Vale, Rio de Janeiro (BR); Tiago Cavalcante Freitas, Rio de Janeiro (BR); Daniel Monteiro Pimentel, Rio de Janeiro (BR); Thiago Da Costa Ribeiro, Rio de Janeiro (BR)

(73) Assignee: PETRÓLEO BRASILEIRO S.A.—PETROBRAS, Rio de Janeiro (BR)

( * ) Notice: Subject to any disclaimer, the term of this patent is extended or adjusted under 35 U.S.C. 154(b) by 105 days.

(21) Appl. No.: 18/317,633

(22) Filed: May 15, 2023

(65) Prior Publication Data

US 2023/0407726 A1 Dec. 21, 2023

(30) Foreign Application Priority Data

May 16, 2022 (BR) ..... 10 2022 009474 8

(51) Int. Cl.
*E21B 37/06* (2006.01)
*E21B 47/00* (2012.01)
(Continued)

(52) U.S. Cl.
CPC ..... *E21B 37/06* (2013.01); *E21B 47/006* (2020.05); *E21B 47/07* (2020.05); *E21B 47/10* (2013.01)

(58) Field of Classification Search
CPC ..... E21B 37/06; E21B 47/006; E21B 47/07; E21B 47/10
See application file for complete search history.

(56) References Cited

U.S. PATENT DOCUMENTS 8,555,914 B2 10/2013 Smith, IV et al.
8,893,795 B2 11/2014 Ayres
(Continued)

FOREIGN PATENT DOCUMENTS

BR 102020016720 3/2022

OTHER PUBLICATIONS

Jordan et al. 2001, Life Cycle Management of Scale Control within Subsea Fields and its Impact on Flow Assurance, Gulf of Mexico and the North Sea Basin, SPE 71557, 16 pp.

*Primary Examiner* — Matthew R Buck
(74) *Attorney, Agent, or Firm* — Knobbe, Martens, Olson & Bear, LLP

(57) ABSTRACT

The present invention relates to a system and process for assisted autonomous treatment for removing and/or inhibiting scale with desulfated seawater on pre-salt production platforms, using production facilities and injection water, without the need of using a stimulation vessel or a workover rig.

9 Claims, 1 Drawing Sheet

(51) Int. Cl.
*E21B 47/07* (2012.01)
*E21B 47/10* (2012.01)

(56) References Cited

U.S. PATENT DOCUMENTS

| | | | | |
|---|---|---|---|---|
| 9,255,465 | B2 | 2/2016 | Smith, IV et al. | |
| 10,801,281 | B2 | 10/2020 | Fontenot et al. | |
| 11,035,211 | B1 | 6/2021 | Sundet | |
| 2009/0223672 | A1* | 9/2009 | Naik | F16L 55/46 166/344 |
| 2024/0018848 | A1 | 1/2024 | Moreira de Silva et al. | |

* cited by examiner

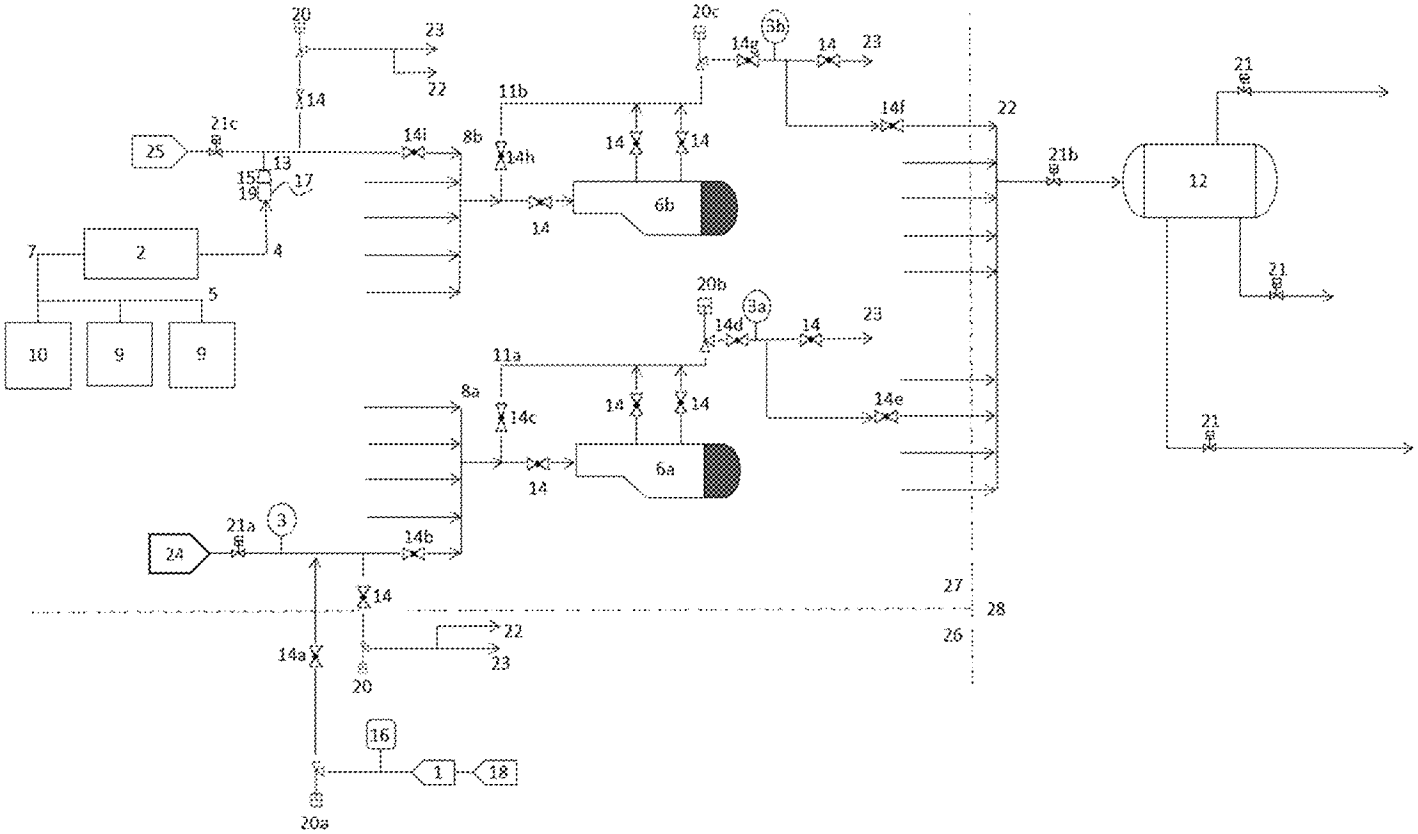

ASSISTED AUTONOMOUS TREATMENT SYSTEM AND PROCESS IN PRE-SALT PRODUCTION PLATFORMS, AND THEIR USES

FIELD OF THE INVENTION

The present invention pertains to the field of Exploration and Production of Oil and Gas, more precisely to the field of reservoir management and guarantee of flow for maintenance of production and refers to a system and a process of assisted autonomous treatment for scale removal using desulfated and deaerated seawater produced on pre-salt production platforms.

BACKGROUND OF THE INVENTION

The scaling removal or inhibition treatment is usually performed in two separate steps with the use of critical resources, which can be performed by using the stimulation vessel, interconnected to the platform through rigid connections and certified cradle with a specialized team, or a workover rig, connected directly to the well WCT. It is worth mentioning that, normally, the production platform teams choose to carry out these operations using a stimulation vessel, as it is a resource cheaper than the rig; however, well activities using this type of vessel compete with the operations carried out with the offloading vessel and UMS (Platform Maintenance and Safety Unit), making it necessary to reschedule the planned operations many times, with great burden for the company. Additionally, changes in weather conditions or loss of dynamic positioning can cause collisions between vessels and Stationary Production Units; therefore, the application of this new technology also eliminates this risk.

Among the points that motivated the search for alternative solutions are (1) detection of damage to the coflexip cradle of the platform, (2) the incompatibility of performing remote treatments with the stimulation vessel in the presence of other vessels, (3) the reduction of costs per operation and (4) eliminates the need of receiving industrial water, through the use of seawater treated by the SPU itself. The reached solution was to carry out the treatment to remove and inhibit the scaling of the pre-salt oil producing well using the production test and injection water facilities, without the need of using a stimulation vessel or a workover rig. The field of application of this new technology will be in managing the reservoir and guaranteeing flow to maintain production in the pre-salt fields.

STATE OF THE ART

Some documents present in the state of the art propose procedures in order to (1) avoid the need of using stimulation vessels to remove scales on pre-salt production platforms, (2) shutdown the production and/or (3) continuous injection of chemicals into off-shore producing wells, for example:

The document BR 10 2020 016720-0, entitled "AUTONOMOUS METHOD OF REMOVAL AND INHIBITION OF SCALE", focuses on the removal of saline scales effectively solubilized by the use of industrial water. As described in patent BR 10 2020 016720-0, this industrial water is delivered to the SPU using vessels, which makes the treatment volume the main limiting point. In the case of the present invention, there is used a system fed by a source of injection water (desulfated and deaerated) from the SPU itself, allowing the preparation of treatment fluid without the need for replenishment by an external unit. This system also allows in-line mixing of the chemical directly, without the need for a mixing tank.

The document on behalf of Jordan et al. entitled "Life Cycle Management of Scale Control within Subsea Fields and its Impact on Flow Assurance, Gulf of Mexico and the North Sea Basin" is a scientific paper presenting an overview of production management and flow assurance throughout the life cycle of a platform and its subsea system. To illustrate this approach, examples of scaling control methods for deepwater fields are cited, encompassing aspects such as (1) treating the reservoir prior to the production to prevent scale from forming within the well and its production system, (2) scaling control by bottom injection into the wells, using continuous injection of specific chemicals depending on the route used (gas lift system, umbilical injection), and (3) strategy of increasing the flow pressure as the production wells have their life cycle completed and the water cut increases. It does not conflict with the invention, as it does not specifically propose a system for removing scales, but options for carrying out a related preventive treatment.

Thus, unlike the state of the art, the present invention proposes an assisted autonomous treatment system for removal and/or inhibition of scale with desulfated water on pre-salt production platforms. It is verified that the counterflow redirection of desulphated water from the injection system to the water injection wells makes it possible to carry out both the treatment of removal and the inhibition of scales by injecting a chemical downstream of the main valve of the producing well.

SUMMARY

The present invention aims at proposing an assisted autonomous treatment system for removal and/or inhibition of scale using desulfated and deaerated seawater on pre-salt production platforms, comprising the following components: Water injection pump (1); Triplex chemical injection pump (2); Pressure gages (3); Flexible hoses (4); Chemical injection header (5); PIG receiver (6); Triplex pump suction lines (7); PIG Receiver Header (8); Chemical container (9); Diesel tank (10); PIG receiver by-pass (11*a*; 11*b*); Test separator (12); Pressure measurement point downstream of the main production SDV (13); Block/alignment valves (14); WECO connection (15); Water injection flow rate meter (16); Depressurization hose (17); Injection water treatment system, including the desulfator (18); Interconnection connections of the triplex pump skid with the injection point (19); Flow rate control valves (20); Shut down valves (SDV) (21); Test header (22); Production header (23); WAG injection well (24); Producing well (25); Border of the water injection system (26); Border of the collection system (27); and Border of the production test system (28).

Additionally, the present invention proposes an assisted autonomous treatment process for removing scale with desulfated seawater on pre-salt production platforms comprising the following steps:

(a) Identification of signs of scaling in producing wells and definition of their location;
(b) Definition of the treatment strategy to be adopted;
(c) Detailing of the adopted strategy and creation of a procedure to comply with the proposal, defining deadlines, responsible people and relevant technical opinions;

(d) Verification of operational status of the necessary resources, shipment of additional rented resources and of chemicals and system assembly;
(e) Testing the production of the well to determine the pre-treatment reference condition;
(f) Shutdown of the producing well to be acidified and/or inhibited;
(g) Execution of the scaling removal and inhibition procedure;
(h) Restart-up of the producing well lined up for the test system; and
(i) Collection of samples and new production test to determine the efficiency of the treatment.

BRIEF DESCRIPTION OF THE FIGURES

To obtain a full and complete view of the objective of this invention, the FIGURE to which references are made is presented, as follows.

FIG. 1 presents a schema showing an example system proposed in the present invention.

DETAILED DESCRIPTION

The present invention describes an assisted autonomous treatment system for removing scale with desulfated seawater on pre-salt production platforms comprising the following components:

Water injection pump (1);
Triplex chemical injection pump (2);
Pressure gages (3);
Flexible hoses (4);
Chemical injection header (5);
PIG receiver (6);
Triplex pump suction lines (7);
PIG Receiver Header (8);
Chemical container (9);
Diesel tank (10);
PIG receiver by-pass (11);
Test separator (12);
Pressure measurement point downstream of the main production SDV (13);
Block/alignment valves (14);
WECO connection (15);
Water injection flow rate meter (16);
Depressurization hose (17);
Injection water treatment system, including the desulfator (18);
Interconnection connections of the triplex pump skid with the injection point (19);
Flow rate control valves (20);
Shut down valves (SDV) (21);
Test header (22);
Production header (23);
WAG injection well (24);
Producing well (25);
Border of the water injection system (26);
Border of the collection system (27); and
Border of the production test system (28).

Additionally, the present invention proposes an assisted autonomous treatment process for removing and/or inhibiting scale with desulfated water on pre-salt production platforms using the previously defined system, comprising the following steps:

(a) Identification of signs of scaling in producing wells and definition of their location;
(b) Definition of the treatment strategy to be adopted;
(c) Detailing of the adopted strategy and creation of a procedure to comply with the proposal, defining deadlines, responsible people and relevant technical opinions;
(d) Verification of operational status of the necessary resources, shipment of additional rented resources and of chemicals and system assembly;
(e) Testing the production of the well to determine the pre-treatment reference condition;
(f) Shutdown of the producing well to be acidified and/or inhibited;
(g) Execution of the scaling removal and inhibition procedure;
(h) Restart-up of the producing well lined up for the test system; and
(i) Collection of samples and new production test to determine the efficiency of the treatment.

The steps of the process performed will be described in more detail below.

(a) Identification of signs of the beginning and evolution of scaling in producing wells and definition of their location:

In this step, analyzes of the evolution and comparison of pressure and temperature data in the sensors of the well are carried out, in addition to simulations of reservoirs and elevation and flow, for example, the monitoring of variations in the parameters of (a) increase in the differential of pressure between the string PDG and the annulus PDG in about 4 to 10 kgf/cm$^2$ (392.27 to 980.67 kPa), (b) temperature variations in the string PDG of −2 to 2° C. and (c) drop in well potential that reaches values greater than 5%.

(b) Definition of the treatment strategy to be adopted:

At this step, a multidisciplinary team is convened to evaluate the collected data and discuss possible strategies, with economic evaluation.

(c) Detailing of the adopted strategy and creation of a procedure to meet the proposal, defining deadlines, responsible people and opening of technical studies to meet specific demands;

Creation of the Operating Procedure to be Followed:

This procedure details the operational sequence that will be carried out according to the type of maritime unit and seeking the best execution efficiency. For example: Definition of treatment volumes ranging from 500 bbl (79.49 m$^3$) to 4500 bbl (715.44 m$^3$); pumping sequence; chemical injection sequence; alignment of production and injection trains; definition of the log of the pressure gauges (pressure ranges observed on the topside during the operating procedure ranging from 80 to 220 kgf/cm$^2$ (7.845 to 21.575 MPa)) and flow rate (flow rate ranges for diesel injection and treatment solution injection applied ranging from 2 bpm (19.08 m$^3$/h) to 30 bpm (286.18 m$^3$/h)); safety requirements, with the execution of the relevant risk analysis, and treatment contact time with the topside production system, subsea and the reservoir rock.

The chemical injection system arrangement is assembled by using the following components: triplex pump (2), chemical injection header (5), diesel tank (10), chemical containers (9), triplex pump suction line (7), with its block/alignment valves, T or Y connections and adaptations, chemical injection hose of 10,000 psi (68.948 MPa) (4), connections (19) of interconnection of the triplex pump skid with the injection point and depressurization hose (17);

(d) Verification of the operational situation of the necessary resources, shipment of additional rented resources and of chemicals and assembly of the system:

Before each operation, it is necessary to verify the operating conditions and availability of the system to be used, planning and renting extra resources to guarantee the necessary adaptations. In this step of the process, the type of chemical is also defined depending on the treatment that will be carried out in the well; e.g., in the case of scale removal and inhibition, a product with mixed function is used (remover and inhibitor).

(e) Testing the production of the well (25) to determine the pre-treatment reference condition (alignment for test separator, 12):

This test will ensure an evaluation of the performance of the treatment, through flow rate data and production profile, with a short time between the previous test and post-treatment;

(f) Shutdown of the producing well to be acidified and/or inhibited;

In this step, the producing well is cleaned with diesel. There is also the downstream pressure gauge disconnection (13) of the main production SDV valve (21*c*). Furthermore, after assembling the chemical injection system, the rented connection (19) must be connected to the pressure measurement point (13), using a WECO connection (15);

(g) Execution of the scaling removal and inhibition procedure:

At this step, the desulfated water will be sent to the producing well through the alignment: shut-down WAG injection well (24), passing through the water flow rate measurement instrument (16) and the choke of the water flow rate control (20*a*), passing through the PIG receiver by-pass of the WAG injection well (8*a*), going to the test header (22) and, from there, being diverted to the PIG receiver by-pass of the producing well (11*b*) and being injected into the producing well (25). From this moment, some points are observed:

Alignment of the water flow through the desulphated seawater injection line (opening of the valve 14*a*) to the out-of-operation WAG well (24);

Alignment opening of the empty slot of the water injection well (valve 14*b* for header 8*a*) with the by-pass (11*a*) of the PIG receiver of the injectors (6*a*);

Alignment of the empty slot of the water injection well with the platform production test system (opening of the valves 14*d* and 14*e*);

Alignment of the producing well to the production test system (opening of the valves 14*i* for the header 8*b*, bypass 11*b* and valve 140, with the exception of a single valve from the by-pass alignment (14*g*) of the producing PIG receiver (6*b*);

Opening of the producing well SDV valve (21*c*);

Pressurization of the production line of the producing well with diesel;

Opening of the WCT of the producing well;

Control of the pressures observed in the topside alignment (sensors 3*a* and 3*b*);

Opening of the by-pass alignment valve of the producing PIG receiver (6*b*) for the test header (opening of the valve 14*g* for the header 22);

Monitoring and control of pressures and pressurization rates observed in the alignment of the subsea production line (sensors 3*a* and 3*b*);

Flow rate adjustment (sensor 16 and flow rate control by chokes 20*a* and 20*b*) of desulphated seawater injected into the producing well;

The scale inhibitor will be injected through the pressure instrument (13), located downstream of the main surface valve (SDV) of the producing well (21*c*). Through this point, the inhibitor and/or acid is injected into the desulphated seawater stream, by using the triplex pump, generating an inhibitor and/or acid solution at the desired in-line concentration (range relative to the scale inhibition concentrations and/or acidification in producing wells: from 2 to 20% v/v), which will be injected into the producing well.

Opening of the triplex pump alignment, start-up of the same and adjustment of the concentrated chemical flow rate (adjustment of the flow rate in the triplex itself);

Pumping of the treatment solution at the desired concentration and flow rate until reaching the required volume.

Waiting for the exposure times of the scale and the reservoir to the injected product;

(h) Restart-up of the producing well lined up for the test separator (12);

(i) Collection of samples and new production test to determine the efficiency of the treatment.

Application

The technology proposed in the present invention can be fully applied in reservoir management and flow assurance in the prevention, restoration or maintenance of oil production with substantial gains for the company and low cost. The technology can also be applied in Stationary Production Units (SPU) where the treatment system via vessel is degraded or inspections have expired.

The necessary adaptations consist of taking advantage of the ease of the desulfated seawater injection system for water injection wells, including an empty slot of a WAG (Water and Gas) type injection well. This desulphated water is directed to the test header, through the alignment of the water injection well with its respective PIG receiver, passing through its by-pass. Arriving at the test header, the water is directed in counterflow through the by-pass of the producing PIG receiver and from there to the producing well, in which the scaling removal and/or inhibition treatment is to be carried out. The chemical to be used in the treatment will be injected in-line at a pressure instrument point downstream of the main SDV of the producing well, using a 10,000 psi (68.948 MPa) chemical injection hose.

Examples of the Invention

The BXY well showed clear signs of scaling in the production string and in the intermediate zone, identified by the PDG sensors and their differentials, as well as by the potential definition production tests, with subsequent associated loss of production. However, despite the teams designing a treatment capable of removing the formed scale and keeping the well inhibited for a few months, it was not possible to carry out the procedure via the stimulation vessel due to the damage identified in the COFLEXIP cradle after a collision event between the deck extension vessel and the Stationary Production Unit (SPU). In this way, the only alternative for treating the well would be workover with a rig, which is an extremely expensive solution with high operational and programming complexity. Thus, an autonomous treatment alternative was proposed that takes advantage of the facilities of the desulfated seawater injection system for WAG-type water injection wells.

After carrying out the new developed process, it was possible to remove the scale from the BXY producing well with a reduction in the cost of the maneuver by 99.98%, a reduction in $CO_2$ equivalent emissions in tons of around 97%, a reduction in procedure execution time from 15 to 7 days and reduction of associated production loss.

Additionally, the developed system was able to bring more safety in the operation of removing and/or inhibiting the scaling, both by making the SPU the only controller of the operational parameters, bringing more sensitivity and flexibility in this control, and by reducing the presence of extra vessels near the platform.

Advantages

Economy/Productivity

The savings generated with the use of the proposed technology is around U$ 1,900,000.00 dollars in each removal or inhibition operation, when compared to the use of a stimulation vessel. If it is necessary to use a rig, the associated savings are from US$ 1,200,000.00 to US$ 1,800,000.00 per day. The rig operation generally lasts 15 days for acidification and inhibition and, therefore, the total rig costs are at least six million dollars. If carried out together with the planning of the operational shutdown, it can represent savings of up to U$ 2,200,000.00 per day during the shutting down time necessary for the execution of the remote treatment, considering that the well has a high potential for oil production.

Health/Safety

Absence of interference from the stimulation vessel with other operations in parallel, such as offloading or UMS. Possible reduction in the need for POB when autonomous operation enters operational routine.

Increased safety in the operation of removing and/or inhibiting the scaling, by making the SPU the only controller of the operational parameters, bringing more sensitivity and flexibility in this control.

Improvement of the log and control of the implemented flow rates, with the possibility of a quick response in case of unexpected variations.

Reliability

As this process dispenses with vessels of the WSSV type with dynamic positioning, possible failures in the navigation system are avoided, which generate a risk of collision between the vessels, and eventually cause the total cancellation of the workover. As the operation safety system is from the SPU itself, the operational risk analysis is facilitated since the routine safety systems of these units are used. This autonomous workover system eliminates the need to control equipment (pumps, valves, PITs, flow rate meters, etc.) external to the vessel and which must be monitored on the WSSV vessel.

Environmental

Disposal of treatment waste can be carried out at the maritime unit itself. In the event of cancellation of the operation, the chemical treatment pills prepared by the WSSV remain as waste on the vessel until disposal is authorized.

Reduction of CO 2 equivalent emissions in tons of around 97%.

Other Advantages

The system may serve as a basis for deployment both in owned and chartered maritime units. In addition, the present system can be adapted to perform non-WSSV-assisted rig treatments in workovers of production wells, reducing the use of critical resources.

As the water used in the proposed autonomous treatment is desulfated seawater produced by the SPU, there is no limit on the volume of water for the application, avoiding the need to sail to land in order to replenish the vessel with water.

Although the invention has been widely described, it is obvious to those skilled in the art that various alterations and modifications can be made without said changes depart from the scope of the invention.

The invention claimed is:

1. An assisted autonomous treatment system on pre-salt production platforms, comprising:

a WAG (water and gas) portion comprising:

a WAG injection well in fluid communication with a WAG injection well line, the WAG injection well line comprising a first shut down valve and a first alignment valve;

a water injection pump fluidly coupled to a desulfated water source;

a first choke valve positioned downstream of the water injection pump, wherein the first choke valve is in fluid communication with the WAG injection well line between the first shut down valve and the first alignment valve;

a first PIG receiver header in fluid communication with the first alignment valve;

a first PIG receiver by-pass in fluid communication with the first PIG receiver header; and a test header in fluid communication with the first PIG receiver by-pass; and a producing portion comprising:

a producing well in fluid communication with a producing line, the producing line comprising a second alignment valve;

a triplex chemical injection pump in fluid communication with the producing line between the producing well and the second alignment valve, the triplex chemical injection pump positioned downstream of a diesel tank;

a second PIG receiver header in fluid communication with the second alignment valve; and a second PIG receiver by-pass in fluid communication with the second PIG receiver header and the test header.

2. The system of claim 1, wherein the system is aligned to send desulphated water to the producing well when the first shut down valve is closed, the first choke valve is open, the second alignment valve is opened, and the water pump is activated to pump desulphated water through the first choke valve and into the WAG injection well line, into the first PIG receiver header and the test header, into the second PIG receiver by-pass, into the producing well line, and into the producing well.

3. The system of claim 2, wherein the desulphated water is produced by a stationary production unit (SPU) and eliminates the need for a preparation tank for the fluid to be injected.

4. The system of claim 3, wherein the SPU is the only controller of log parameters, control, and safety.

5. The system of claim 1, wherein the system is aligned to send desulphated water from the desulphated water source to the WAG injection well when the first shut down valve is open and the water pump is activated to pump the desulphated water into the WAG injection well.

6. The system of claim 1, wherein the system is aligned to test the producing well when the second alignment valve is open to open a flow path to the second PIG receiver header and the second PIG receiver by-pass.

7. The system of claim 1, wherein the system is aligned for injection of diesel fuel into the producing well when a second shut down valve is open, the second alignment valve is closed, and the triplex chemical injection pump is activated to pump diesel from the diesel tank into the producing well line.

8. The system of claim 1, wherein the first choke valve is configured to adjust the flow rate of desulphated seawater injected into the producing well.

9. The system of claim 1, wherein a scale inhibitor is injected into the producing well line via the triplex chemical injection pump.

* * * * *